US006941689B1

(12) United States Patent
Seidl

(10) Patent No.: US 6,941,689 B1
(45) Date of Patent: Sep. 13, 2005

(54) SELF-OVERLAPPING LABEL

(75) Inventor: Peter Seidl, Munich (DE)

(73) Assignee: Schreiner GmbH & Co., KG, Oberschleissheim (DE)

( * ) Notice: Subject to any disclaimer, the term of this patent is extended or adjusted under 35 U.S.C. 154(b) by 156 days.

(21) Appl. No.: 10/110,339

(22) PCT Filed: Oct. 11, 2000

(86) PCT No.: PCT/EP00/10031

§ 371 (c)(1),
(2), (4) Date: Aug. 5, 2002

(87) PCT Pub. No.: WO01/29804

PCT Pub. Date: Apr. 26, 2001

(30) Foreign Application Priority Data

Oct. 15, 1999 (DE) ..... 199 49 778

(51) Int. Cl.[7] ..... G09F 3/00
(52) U.S. Cl. ..... 40/310
(58) Field of Search ..... 40/310, 306, 638; 428/40.1, 41.8, 41.7; 206/332, 831; 283/81, 283/94, 105, 106, 103; 281/5, 2

(56) References Cited

U.S. PATENT DOCUMENTS 1,686,354 A * 10/1928 Wallace ..... 40/310
1,896,834 A * 2/1933 Brown ..... 40/306
1,949,903 A * 3/1934 Fales ..... 434/298
1,974,401 A * 9/1934 Miller ..... 40/306
2,093,985 A * 9/1937 Stansbury ..... 40/306
2,706,865 A * 4/1955 Miller ..... 40/306
4,529,229 A * 7/1985 Glibbery ..... 283/81
4,621,442 A * 11/1986 Mack ..... 40/638
4,744,591 A * 5/1988 Instance ..... 281/5
6,027,598 A * 2/2000 Anderson ..... 156/253
6,613,410 B1 * 9/2003 Sellars ..... 428/40.1
6,669,804 B2 * 12/2003 Pendry et al. ..... 156/252

FOREIGN PATENT DOCUMENTS

| | | |
|---|---|---|
| DE | 867 791 C | 2/1953 |
| DE | 41 32 493 C | 3/1993 |
| DE | 197 46 011 C | 1/1999 |
| GB | 2 299 568 A | 10/1996 |

* cited by examiner

*Primary Examiner*—Mark T. Le
(74) *Attorney, Agent, or Firm*—Nixon Peabody LLP; Donald R. Studebaker

(57) ABSTRACT

The invention relates to a label for application to preferably round containers. The label consists of several wing components (H, M, V) one of which can be folded over in such a way that the upper side of the said wing component lies on the upper side of the label. When said label is applied to a container the multiple perimeter of said container can be used to display information on contents, use and the like.

24 Claims, 3 Drawing Sheets

SELF-OVERLAPPING LABEL

The invention relates to a label to be applied to a preferably round container so as to overlap itself, and to a method for its application.

Labels of this type are known as "wrap-around labels", for example from DE 197 46 011. They are normally used when a container with only a very small circumference is available which, nevertheless, is to be provided with a large amount of information relating to the content, expiry date or use. Examples of applications are drug containers such as disposable injections or ampoules, in which the diameter is frequently no more than about 1 cm. Since, precisely in the case of medicaments, it is fatal if such containers are not adequately provided with information relating to proper administration and the like, it is of particular importance that the space available on the container is used as efficiently as possible. Labels of this type are often provided with separable tabs which, for example, are separated from the container in order to log the administration of a medicament and, for example, can be stuck into a patient file or the like. The overlapping part of a "wrap-around label" described above can thus in principle have any desired length, which can correspond to a multiple of the circumference of the container, depending on the amount of information provided on the label. However, limits are placed on this length for practical reasons. If the overlapping part corresponds to the circumference of the container, the application of such labels to the container is already very complicated and time-consuming. In addition, the overlapping part must be detachably fixed with adhesive at at least one point. If the length of the overlapping part becomes greater than the simple circumference of the container, fixing may be brought about only with extreme difficulty, since handling becomes inconvenient as a result of multiple wrapping.

The object of the present invention is, therefore, to provide a label of the type mentioned at the beginning which is distinguished by simple production and handling and in which large information areas are available. Above all, the possibility is to be provided of making an information area available which corresponds to a multiple of the circumferential area of the container.

According to the present invention, this object is achieved by a label for self-overlapping application to a preferably round container, the label being wound around the container in the application direction. In this case, the label has a base layer and a first adhesive layer applied to the underside of the base layer in a middle part thereof to fix the label to the container, a front flap part and a rear flap part, which are each arranged in the application direction on either side of the middle part of the label, a fold line in the area between the front flap part and the middle part.

As a supplement to this, according to an advantageous embodiment of the invention, the label has holding means to fix the two flap parts to the base layer in the area of the middle part. As a result, if it is desired, fixing of the flap parts can be achieved.

According to a further advantageous embodiment of the present invention, one or more folds are provided in the area of the front flap part. As a result, the front flap part can be folded into itself once more. This makes it possible to design the front flap part to be even longer, which creates additional space for the application or display of information and the like. In the case of a plurality of folds, the front flap part can be folded up on the accordion principle, so that a large amount of information can be accommodated in a space-saving manner.

The length of the base layer in the application direction of the label, according to an advantageous embodiment of the present invention, can be designed in such a way that is greater than the circumference of the container. As a supplement to this, the length of the first adhesive layer in the application direction can substantially correspond to the circumference of the container. The label can be fixed permanently to the container by its middle part, while the two flap parts can be wound detachably around the middle part and applied to the middle part by the holding means. If the lengths of the two flap parts and of the middle part are chosen, for example, such that they respectively correspond to the circumference of the container, then approximately five times the circumference of the container can be used to display information.

According to a further advantageous embodiment of the present invention, the front flap part and/or the rear flap part have non-stick areas on the underside of the base layer. By this means, excessively strong bonding of the flap parts and the provision of non-stick substances can be ruled out to the greatest possible extent. The front flap part advantageously has an adhesive layer on the underside of the base layer, and the rear flap part has a non-stick coating on the underside of the base layer. When the label is applied to a container, better fixing of the two flap parts can be achieved in this way. Of course, it is likewise possible instead to configure the label in such a way that the rear flap part has an adhesive layer on the underside of the base layer, and that the front flap part has a non-stick coating on the underside of the base layer.

There is often the desire on the part of the user to separate part of the label from the container and store it in another location for the purpose of logging. The front flap part therefore has at least one perforation line, which permits at least part of the front flap part to be separated. In addition, the rear flap part can alternatively or additionally have at least one perforation line for this purpose, which in turn permits at least part of the rear flap part to be separated.

According to a particularly advantageous embodiment, the rear flap part is longer than the front flap part. This permits particularly simple fixing of both flap parts to the middle part with only one adhesive bond. For this purpose, for example, a second adhesive layer can be provided on the rear flap part, on the underside of the base layer, as a holding means. Said adhesive layer can either be applied in such a way that it comes to lie on the front flap part when the label is applied to the container or the front flap part, together with the rear flap part, is fixed by the second adhesive layer resting on the middle part.

To this end, if repeated detachment and fitting of the flap parts is desired, it is particularly advantageous to provide a non-stick smooth layer part on the side of the base layer facing away from the underside in order to accommodate the second adhesive layer.

Furthermore, a third adhesive layer is provided on the front flap part, on the side of the base layer facing away from the underside, as a holding means. In this way, the front flap part can also be fixed independently of the rear flap part.

According to a further advantageous embodiment, the label is provided with one or more imprints, punched portions or embossings in at least part of the underside of the base layer. Alternatively or additionally to this, imprints, punched portions or embossings can also be provided, at least to some extent, on the side facing away from the underside of the base layer.

According to a further advantageous embodiment of the present invention, the non-stick areas of the label are designed to be at least partly non-stick. This can preferably be achieved by applying a non-stick material to adhesive areas. As a supplement to this, one or more information carriers can be adhesively bonded onto these areas provided with a non-stick coating. The provision of the preferably self-adhesive information carriers permits the application of additional information to the label according to the invention. The information carriers can be removed during subsequent use and preferably stuck on again at a different point, for example in order to log the administration of a drug or the like.

Furthermore, according to a further advantageous embodiment, provision is made for the rear flap part to have at least one separable information portion at its end facing away from the middle part, said section having a fourth adhesive layer on the underside of the base layer. In this way, in a manner similar to that outlined for the tabs, further items of information that can be separated from the label to be stuck at a different location can be applied to the label according to the invention.

The separable information portion is preferably part of the base layer, so that it can be produced in one piece with the label. In order to separate the at least one information portion from the base layer, a second perforation is provided in accordance with a further embodiment of the present invention.

The invention also relates to a method of labeling a preferably round container, the label being wound around the container in the application direction and having the following: a base layer and a first adhesive layer applied to the underside of the base layer in a middle part thereof, a front flap part and a rear flap part, which are each arranged in the application direction on either side of the middle part of the label, a fold line in the area between the front flap part and the middle part and holding means for fixing the two flap parts to the base layer in the area of the middle part. Here, the label is folded over along the fold line in such a way that the front flap part lies on the middle part, and the label is guided onto the container with the edge produced by the folding operation as the leading edge.

According to an alternative of the method, the folding operation is carried out immediately before the application operation. Here, there is still the possibility for the customer for his part to provide the label with imprints, punched portions or the like until the time of application. As an alternative to this, imprints of this type can even be made by the producer of the labels, so that no further imprints are required, at least in the folded-over area. The folding operation can then be carried during the production of the label.

Furthermore, the invention relates to a container having a preferably round portion, on which a label is adhesively bonded which has the following: a base layer and a first adhesive layer applied to the underside of the base layer in a middle part thereof and with which the label sticks to the portion of the container, the base layer being longer than the circumference of the portion and the adhesive layer having approximately the same length as the circumference of the portion, a front flap part, which is folded back onto the middle part along a fold line in the area between the front flap part and the middle part, and a rear flap part, which at least partly covers the front flap part and the middle part, holding means being provided to fix the two flap parts.

The invention also relates to an apparatus for producing a label web, to which apparatus a label web is supplied, in which the labels are adhesively bonded onto a non-stick carrier web, and a front flap part of the labels, leading in the running direction of the carrier web, having no adhesive contact with the carrier web, and the apparatus having a folding device for folding over the front flap part of the labels.

Furthermore, the apparatus can have a transfer device for transferring the folded labels from the carrier web to a further carrier web. The labels, produced in one piece in accordance with the method of the invention, are generally ready-made on a siliconized, non-stick carrier web. They are usually ready-made in such a way that the labels are applied to the carrier web over their entire length, that is to say with the flap parts folded out, so that the labels have a specific spacing a from one another. If these labels are to be made ready to be applied, the flap part leading in the running direction is folded over, so that the spacing of the labels from one another is increased and then has a length b. In order to conserve the resources of the material of the carrier web, a transfer apparatus is provided on the apparatus according to the invention. Here, the folded labels are transferred to another carrier strip, specifically in such a way that the labels on this carrier strip have a spacing of only c, where $c<b$. In this case, c can approach zero if required.

In order to fix the folded portion better to the part of the label still connected to the carrier web, according to an advantageous embodiment of the apparatus according to the invention, an apparatus for applying adhesive is provided upstream of the folding apparatus. A drop of adhesive or adhesive wax is applied to the label, which then fixes the folded part to the rest of the label during the folding operation in order better to make it ready. This provisional adhesive bond is used merely for improved transport and improved storage and is then removed again permanently by the application of the labels.

According to a further advantageous embodiment of the apparatus according to the invention, the apparatus has a feed control system for the further carrier web, by means of which the feed of the further carrier web is controlled in such a way that the spacing between two successive labels is reduced.

The invention and its advantageous embodiments will be explained schematically in more detail below using FIGS. 1 to 7, in which.

Figure 1:
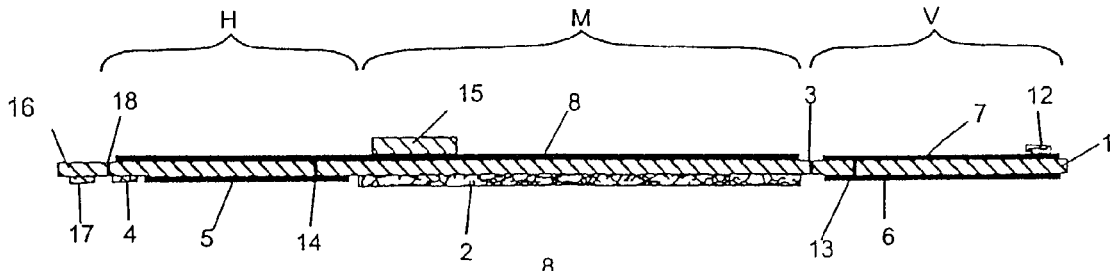
FIG. 1 shows a first embodiment of the label according to the invention in a side view.

FIG. 1 shows a first embodiment of the label according to the invention to be applied to a round container or the like. It has a base layer 1, to whose underside an adhesive layer 2 is applied for the purpose of adhesive bonding to the container. In this sense, "underside" is to be understood to mean that side of the base layer 1 which is at least partly coated with adhesive and which is used to fix the label to the container. The the opposite side is referred to as the "upper side". The length of the adhesive layer preferably has a length which corresponds approximately to the circumference of the container to which the label is to applied. The part of the label that is provided with the adhesive layer 2 forms the middle part M. In particular, the adhesive layer 2 can be applied to the label by the manufacturer. Alternatively, there is the possibility that an adhesive coating will be carried out only during application. This can either be done by applying adhesive to the label during the application operation or by applying adhesive to the container on which the application is to take place. At the side of the middle part M there are two substantially non-stick flap parts H and V.

The non-stick areas on the underside of the base layer can be implemented either by the adhesive layer being applied selectively only in the area of the middle part M. Alternatively, it is possible to cover the entire area of the underside of the base layer 1 with adhesive and then to provide the areas which are not to stick with coverings.

The front flap part V of the label, leading in the application direction, is designed such that it can be folded over along a fold line 3. There is the possibility of configuring one or both flap parts to be separable. To this end, perforations 13, 14 can be provided in the base layer. The entire label is available for the application of information of all types, such as the type and use of the contents of the container, expiry date or the like. Thus, the upper side and underside can be provided with imprints, punched portions or embossings 5 to 8.

If the base layer is of transparent design, then the entire label can be provided with information on both sides by printing one side of the upper side. To this end, the information which is conceived for the underside is printed in mirror-image form on the upper side. Then, for example, a colored covering layer can be printed over it, on which the information conceived for the other side can in turn be applied. As a result of this measure, it is possible to dispense with a complicated process step of rotation in order to label the rear side. In addition, in the case of printing of this type, the adhesive layer 2 on the underside does not present any problems if the labels are only to be printed by the end user. In addition, imprints which are connected to an adhesive layer are not infrequently severely restricted in terms of their durability. In order to make the labels ready, these can be applied to a non-stick carrier web. If the labels are, for example, provided on both sides with information in accordance with the process described above, then it is useful to provide the carrier web in transparent form. It is then subsequently possible to check whether the imprint on the underside is faulty or not.

The rear flap part H, trailing in the application direction, has an adhesive layer 4 on the underside, in the edge area. If the label is applied to a container, the otherwise adhesive-free rear flap part H can be bonded adhesively by means of this adhesive layer 4. At the point on the upper side of the label on which this part coated with adhesive 4 comes to lie, an adhesion repeller 15 is preferably applied, so that the bond at this point is not permanent. In this way, the rear flap part remains detachable and can be fastened again at any time. In order to fix the folded front flap part V to the middle part of the label, an adhesive bond 12 can likewise be provided at the outer edge of the front flap part. In a corresponding way, it is possible to provide an adhesion repeller (not shown) on the label in order to accommodate the adhesive bond 12 on the upper side of the label. Said adhesion repeller can be dispensed with, for example, when the rear flap part H is longer than the front flap part V, then, together with the rear flap part, by means of its adhesive surface 4, the front flap part V can also be fixed to the upper side of the label as the latter is applied.

Figure 2:
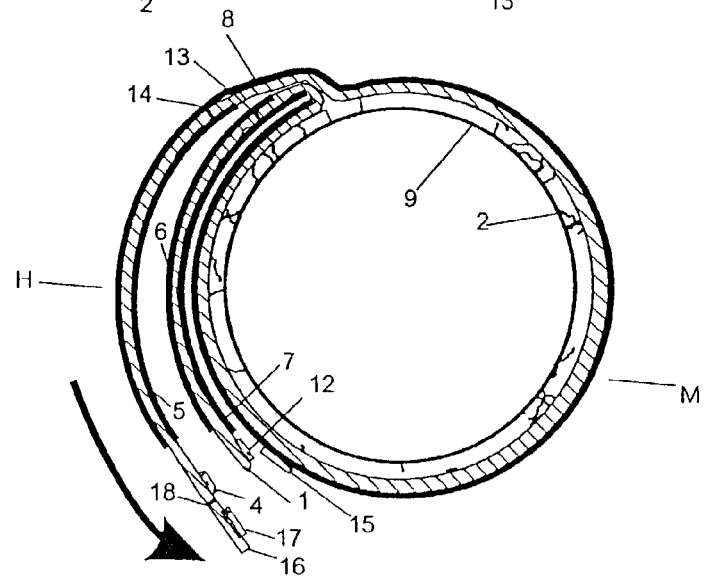
FIG. 2 shows a cross section of a label according to the invention, applied to a round container.

FIG. 2 shows a cross-sectional illustration of a label according to the invention which has been applied to a round container 9. For the purpose of application, the label is folded over along the fold line 3 in such a way that the front flap part V lies on the middle part M, and the label is guided onto the container with the edge produced by the folding operation as the leading edge. The two flap parts are then pressed against the middle part in the direction of the arrow and, if appropriate, fixed there. In the process, the rear flap part H at least partly covers the front flap part V folded over in the direction of the upper side of the label. Front flap part and rear flap part can in each case be individually connected detachably to the upper side of the label, preferably in the area of the middle part, via the adhesive layers 4 and 12, respectively. In order to accommodate further information, one or more further tabs 16 can be provided, preferably formed in one piece with the label base layer 1. The tabs can be separated from the label and have an adhesive layer for fixing at a different location. For improved separation from the base layer, perforations 18 are provided.

Figure 3:
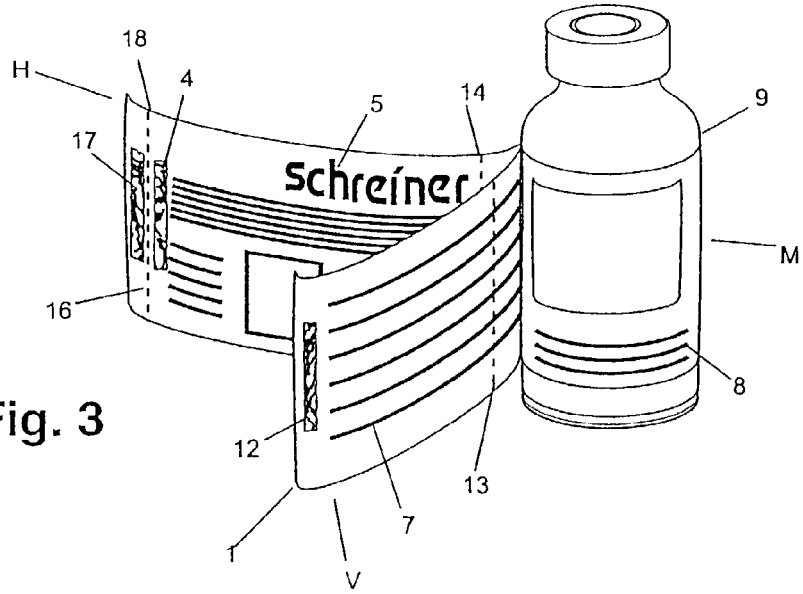
FIG. 3 shows an example of a label applied in accordance with the invention to a round container, in a perspective view.

FIG. 3 illustrates a label applied in accordance with the invention to a round vessel 9, in a perspective view. The two flap parts are in this case not fixed to the middle part. All the parts of the label can be provided with different items of information. Furthermore, the flap parts can be designed to be separable. To this end, for example perforations 13, 14 are provided. For instance, instructions for use or tabs to be kept at a different location can be accommodated on these separable portions. Other information 8, which relates for example to the content of the container and therefore is to remain permanently on the container, can be applied to the middle part M of the label, which adheres permanently to the container 9.

Figure 4:
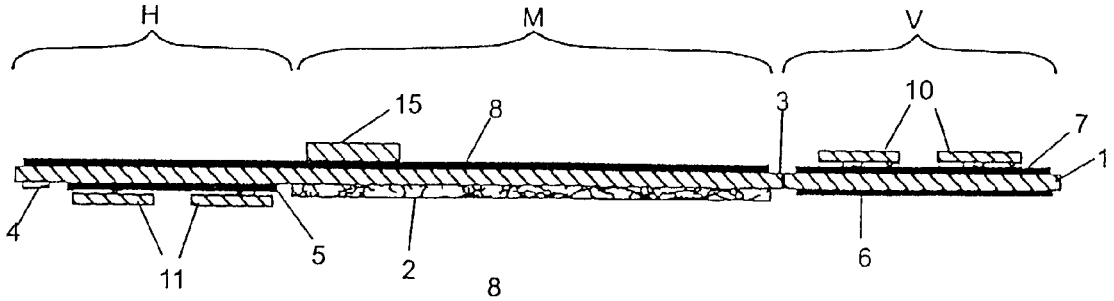
FIG. 4 shows a further embodiment of the label according to the invention in a side view.

FIG. 4 shows a variant of the label according to the invention. In addition to the printed information 8, 7 on the upper side and the information 5, 6 on the underside, the label is provided here with detachable tabs 10, 11 in the area of the upper side of the front flap part V and the underside of the rear flap part H. The tabs 10, 11 are preferably designed as self-adhesive labels, so that after being detached they can be stuck on either at the same point or, for the purpose of logging, for example of the successful administration of a drug, can be stuck at a different location, for example in a patient file. For this purpose, a non-stick layer of siliconized material or the like can be applied to the label according to the invention, so that the tabs 10, 11 can be removed from the remaining label without destruction. Of course, these same or further tabs can also be applied at locations on the label other than those mentioned.

Figure 5:
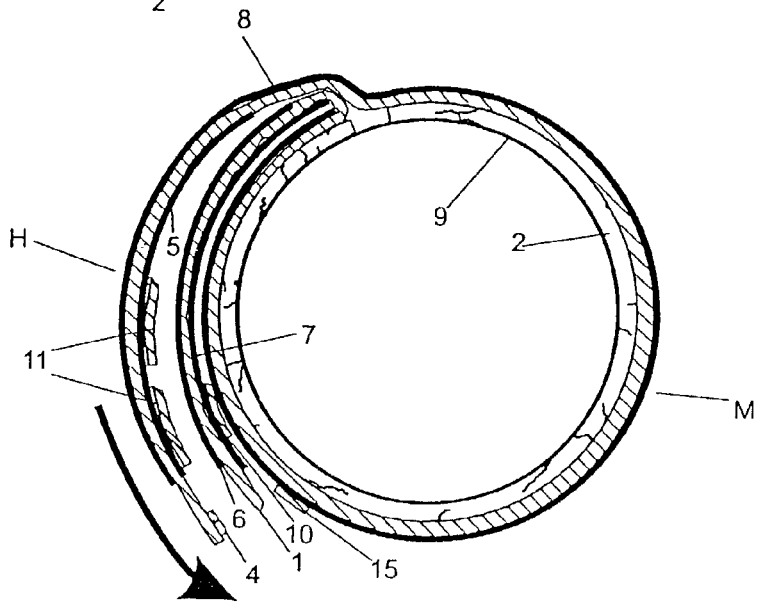
FIG. 5 shows a cross section of a further label according to the invention applied to a round container.

FIG. 5 shows the label described in FIG. 4 stuck onto a round container 9, in a cross-sectional view. The tabs 10, 11 are in this case arranged such that they each lie on the "insides" of the two flap parts. This has the advantage that the tabs 10, 11 are provided with additional retention by the fixing of the flap parts. Although the application of the tabs to the outer side is possible, it has been shown that, particularly in the case of containers with a very small radius, such as injections, ampoules or the like, self-adhesive labels very easily become detached by themselves, because of the arcuate curvature of the carrier material which is present in the case of a small radius, so that secure application is not always possible. In the variant in FIG. 5, the tabs can obtain additional retention as a result of the fixing of the two flap parts.

Figure 6:
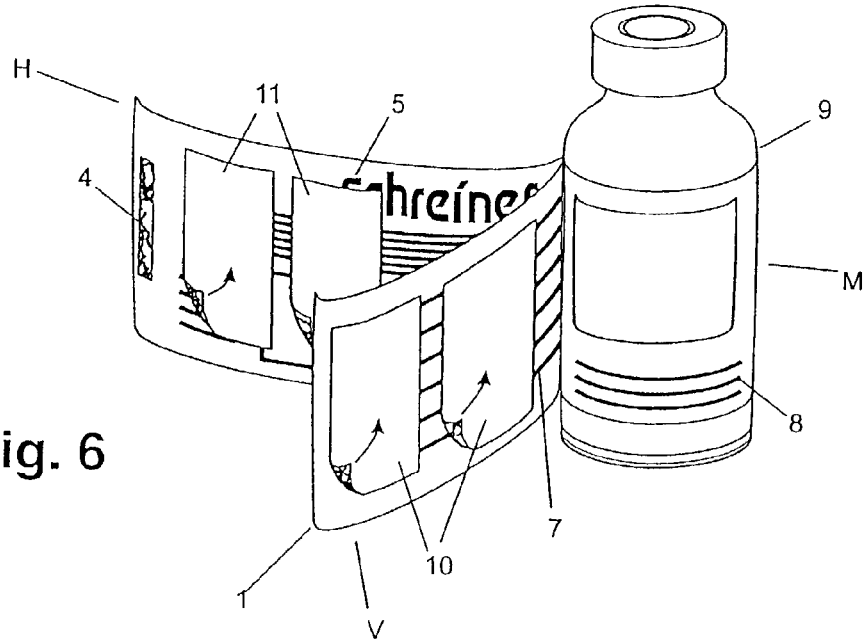
FIG. 6 shows an example of a further label applied in accordance with the invention to a round container, in a perspective view.

FIG. 6 shows once more a round container 9 provided with a label according to the invention in a perspective illustration. The tabs 10, 11, preferably formed as self-adhesive labels, can in this case be provided as an alternative or as a supplement to the separable tabs 16 shown in FIGS. 2 and 3, depending on the application. In FIG. 6, for example, no portions that can be separated along a perforation line are shown. Here, provision is made for all the items of information 5, 7, 8 to remain permanently joined to the container 9. In addition, detachable tabs are provided on the inner sides of the two flap parts H, V. In this case, the rear flap part is slightly longer than the front flap part V, so that the latter, together with the rear flap part H, can be fixed to the middle part of the label M by means of a single adhesive bond 4.

Figure 7:
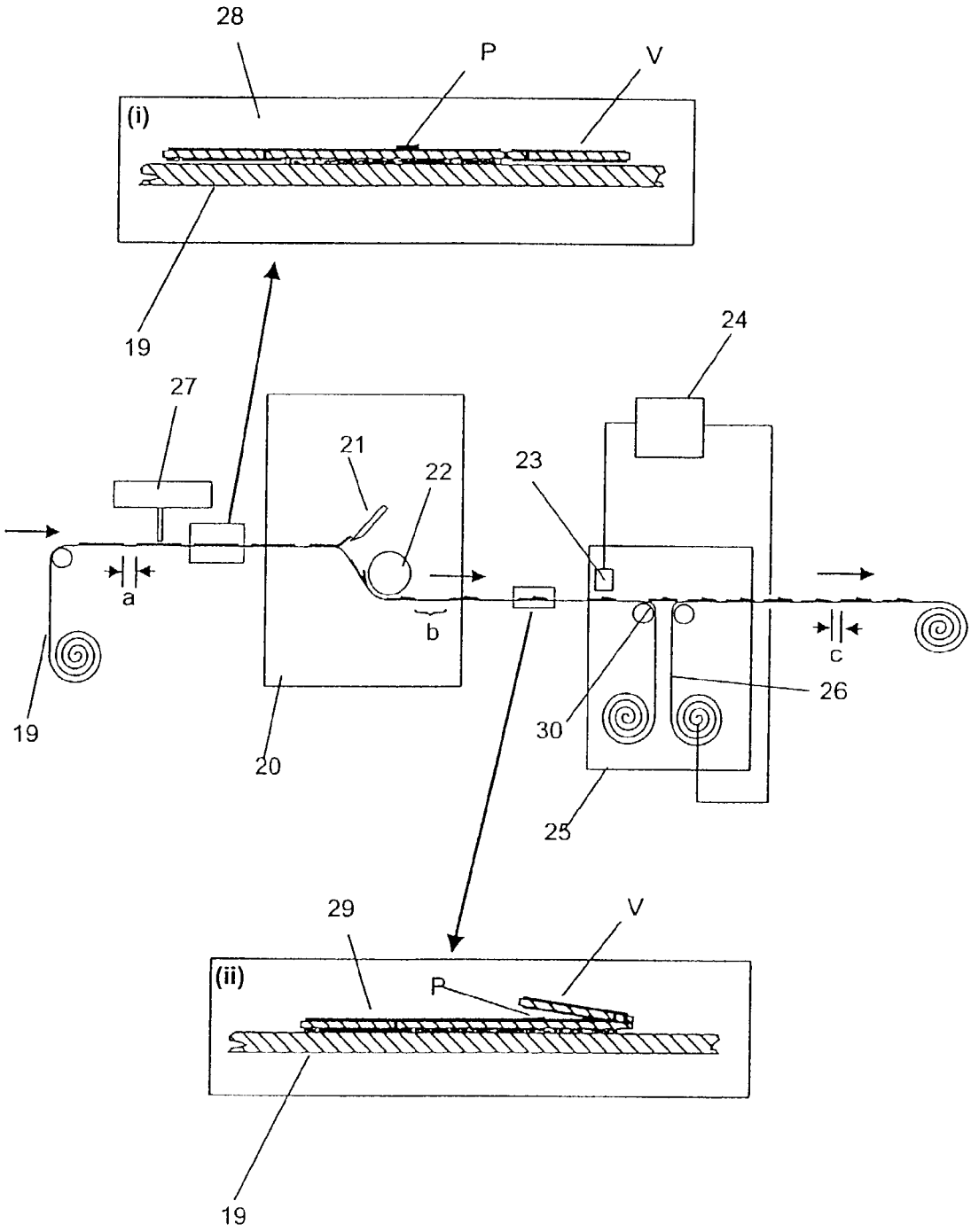
FIG. 7 shows an example of an apparatus according to the invention with a folding and transfer device, in side view.

FIG. 7 shows, in schematic form, an apparatus for providing the labels according to the invention ready to be applied. As shown in the detailed enlargement (i), the labels according to the invention are provided in the folded-out state 28 on a first carrier web 19. The carrier web 19 generally comprises a plurality of labels arranged in this manner and is supplied to the apparatus according to the invention in such a way that the labels run with their front flap part, which does not adhere to the carrier web 19, in front. At this time, the labels on the carrier web 19 have a spacing a from one another. The spacing a can be as small as desired. In order to be able to apply the labels 28 in accordance with the method of the invention, the front flap part V has to be folded over in the direction of the upper side of the labels. This is achieved by means of a folding edge 21 and a roll 22 in the folding device 20. The front flap part of a label 28 is lifted by the folding edge 21 and folded over and then pressed against the upper side of the label by means of the roll 22. A gluing device 27 can be connected upstream of the folding device, providing the upper side of the labels 28 with a spot of adhesive P made of adhesive wax or the like. As a result, when the front flap part V is folded over, it can be fixed to the upper side of the label, so that during the subsequent application no problems with loose front flap parts occur. This spot fixing P is then irreversibly released in the course of the application.

After the labels have passed through the folding device 20, the spacing between the labels has been increased precisely by the length of the folded front flap part. This new spacing b can in principle be very considerable, depending on the desired size of the front flap part V, so that making said labels ready on a carrier web 19 with spacings which can be a multiple of the label length is not desirable, particularly for reasons of the immense consumption of carrier material. In addition, problems can arise during the application of the labels, in particular the application system is unnecessarily loaded by the empty portions of the carrier material web. In order to correct this, the folded labels 29 (see detailed enlargement (ii)) are supplied to a transfer device 25. In this device, the labels 29 are transferred from the carrier strip 19 to another carrier strip 26, so that the spacing of the labels is finally c<b, it being possible for c to approach zero. To this end, the transfer device has a sensor 23, which is connected to a computing unit 24. The sensor 23 detects the presence of the labels 29 on the carrier web 19 and, at a known running speed of the carrier web, also the spacing b of the labels. The drive of the other carrier strip is then controlled, via the computing unit 24, so that the labels 29, which are detached from the carrier web 19 at the spacing b as a result of the carrier web 19 being deflected at the edge 30, are placed on the new carrier web 26 at a smaller spacing c. The labels 29 prepared in this way can then be applied in accordance with the invention.

What is claimed is:

1. A label for self-overlapping application to a container, the label having a top side and a bottom side and being wound around the container in the application direction and comprising:

a base layer having a bottom side extending along the entire length of the base layer and a first adhesive layer applied to the bottom side of the base layer in a middle part thereof to fix the label to the container, a front flap part and a rear flap part, which are each arranged in the application direction on either side of the middle part of the label, a fold line in the area between the front flap part and the middle part, and holding means attached to the bottom side of said base layer in the area of the rear flap part for sealing the rear flap part over the front flap part and the middle part such that the bottom side of the base layer in the area of the rear flap part is directed towards the middle part.

2. The label as claimed in either of claim 1, characterized in that one or more folds are provided in the front flap part.

3. The label as claimed in claim 1, wherein the length of the base layer in the application direction is greater than the circumference of the container.

4. The label as claimed in claim 1, wherein the length of the first adhesive layer in the application direction is substantially equal to the circumference of the container.

5. The label as claimed in claim 1, wherein the front flap part (V) and/or the rear flap part have nonadhesive areas on the underside of the base layer.

6. The label as claimed in claim 1, wherein the front flap part has an adhesive layer on the underside of the base layer, and in that the rear flap part has a non-stick coating on the underside of the base layer.

7. The label as claimed in claim 1, wherein the front flap part has at least one perforation line which permits at least part of the front flap part to be separated.

8. The label as claimed in claim 1, wherein the rear flap part has an adhesive layer on the underside of the base layer, and in that the front flap part has a non-stick coating on the underside of the base layer.

9. The label as claimed in claim 1, wherein the rear flap part has at least one perforation line which permits at least part of the rear flap part to be separated.

10. The label as claimed in claim 1, wherein the rear flap part is longer than the front flap part.

11. The label as claimed in claim 1, wherein a second adhesive layer is provided on the underside of the base layer on the rear flap part as a holding means.

12. The label as claimed in claim 11, characterized in that a non-stick smooth layer part is provided on the side of the base layer facing away from the underside in order to accommodate the second adhesive layer.

13. The label as claimed in claim 1, wherein a third adhesive layer is provided on the front flap part, on the side of the base layer facing away from the underside, as a holding means.

14. The label as claimed in claim 1, wherein in at least part of the underside of the base layer, it is provided with imprints, punched portions or embossings.

15. The label as claimed in claim 1, wherein on the side of the base layer facing away from the underside, it is at least partly provided with imprints, punched portions or embossings.

16. The label as claimed in claim 1, wherein the nonadhesive areas are at least partly provided with a non-stick coating.

17. The label as claimed in claim 16, characterized in that information carriers are adhesively bonded onto the areas provided with the non-stick coating.

18. The label as claimed in claim 1, wherein the rear flap part has a separable information portion at its end facing away from the middle part, said section having a fourth adhesive layer on the underside of the base layer.

19. The label as claimed in claim 18, characterized in that the separable information portion is part of the base layer.

20. The label as claimed in claim 19, characterized in that in order to separate the at least one information portion from the base layer, a second perforation is provided.

21. A method of labeling a container, the label having a top side and a bottom side and being wound around the container in the application direction, the label comprising:

a base layer and a first adhesive layer applied to the bottom side of the base layer in a middle part thereof, a front flap part and a rear flap part, which are each arranged in the application direction on either side of the middle part of the label, a fold line in the area between the front flap part and the middle part, holding means for sealing the rear flap part over the front flap part and the middle part said method comprising the steps of:

folding the label over along the fold line such that the front flap part lies on the middle part and the label is guided onto the container with the edge produced by the folding operation as the leading edge, and wrapping the label around the container in the same direction until the rear flap part overlaps the front flap part and the middle part such that the bottom side of the base layer in the area of the rear flap part is directed towards the middle part and the label is sealed over the front flap part and the middle part.

22. The method as claimed in claim 21, characterized in that the folding operation is carried out immediately before the application operation.

23. The method as claimed in claim 21, characterized in that the folding operation is carried out during the production of the label.

24. A container having a portion, on which a label is adhesively bonded, which has the following:

a base layer (1) having a first side extending along the entire length of the base layer and a first adhesive layer (2), which is applied to the first side of the base layer (1) in a middle part (M) thereof and with which the label sticks to the portion of the container, the base layer being longer than the circumference of the portion and the adhesive layer having approximately the length of the circumference of the portion, a front flap part (V), which is folded back onto the middle part (M) along a fold line (3) in the area between the front flap part (V) and the middle part (M), and a rear flap part (H), which at least partly covers the front flap part and the middle part, holding means (4) being provided on the first side of the base layer in the area of the rear flap part to fix the two flap parts (V, H).

* * * * *